US006696779B2

(12) United States Patent
Tuyls

(10) Patent No.: US 6,696,779 B2
(45) Date of Patent: Feb. 24, 2004

(54) DEFLECTION YOLK

(75) Inventor: Pim Theo Tuyls, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/095,831

(22) Filed: Mar. 12, 2002

(65) Prior Publication Data

US 2002/0121853 A1 Sep. 5, 2002

(30) Foreign Application Priority Data

Mar. 16, 2001 (EP) ..... 01200986

(51) Int. Cl.[7] ..... H01J 29/70
(52) U.S. Cl. ..... 313/440; 335/210; 335/213
(58) Field of Search ..... 313/440; 335/210, 335/211, 212, 213

(56) References Cited

U.S. PATENT DOCUMENTS

| | | | | |
|---|---|---|---|---|
| 3,246,192 A | | 4/1966 | Torsch | 313/76 |
| 3,694,781 A | | 9/1972 | Sawada | 335/210 |
| 4,754,190 A | * | 6/1988 | Hinotami et al. | 313/422 |
| 5,786,661 A | | 7/1998 | Kim | 313/440 |
| 6,380,698 B1 | * | 4/2002 | Dasgupta | 315/368.25 |
| 6,452,321 B1 | * | 9/2002 | Kojima | 313/440 |
| 6,552,483 B1 | * | 4/2003 | Cho et al. | 313/440 |

FOREIGN PATENT DOCUMENTS

| | | | |
|---|---|---|---|
| EP | 0 859 397 | 8/1998 | H01J/29/76 |
| EP | 0886297 A2 | 12/1998 | H01J/29/70 |
| EP | 0981149 A1 | 2/2000 | H01J/29/76 |
| EP | 1102301 A1 | 5/2001 | H01J/29/76 |
| JP | 61-080739 | 4/1986 | H01J/29/76 |
| WO | WO 0055883 | 9/2000 | H01J/29/76 |

OTHER PUBLICATIONS

Patent Abstracts of Japan vol. 1995, No. 05, Jun. 30, 1995, JP07037525A.

Patent Abstracts of Japan, vol. 013, No. 046, (E–711), Feb. 02, 1989, JP 63241843A.

Patent Abstracts of Japan, vol. 016, No. 294, (E–1225), Jun. 29, 1992, JP04079133A.

* cited by examiner

*Primary Examiner*—Edward J. Glick
*Assistant Examiner*—Elizabeth Gemmell

(57) ABSTRACT

The present invention relates to a yoke ring for use in a deflection unit in a cathode ray tube (CRT). The yoke ring having a neck and a flared side, and being defined by an inner and an outer contour. According to the invention, the inner contour is periodically deformed in the radial direction, the contour having at least two local minima and maxima. This deformation influences the magnetic field generated by the coils in the CRT, leading to improved front-of-screen performance. In particular, astigmatism, coma and raster errors are reduced.

12 Claims, 6 Drawing Sheets

DEFLECTION YOLK

BACKGROUND AND SUMMARY

The present invention relates to a toroidal deflection yoke core in the deflection unit of a cathode ray tube, also referred to as yoke ring.

One of the parts of a cathode ray tube (CRT) is the deflection unit (DU), holding the deflection coils which generate a magnetic field to deflect electrons from the cathodes to the appropriate points on the screen. The ring-shaped deflection yoke, normally made of ferrite, surrounds the deflection coils in order to keep the magnetic field inside the deflection volume. For a perfectly symmetrical yoke, the magnetic field is amplified, as multipoles generated by the coils are reflected by the yoke.

The position on the screen and the landing angle at which the electrons arrive on the screen vary approximately linearly with the current in the coils (Gaussian approximation). In reality, however, this is not a perfect approximation and generates significant errors in situations where large currents are needed.

Such errors are a serious problem when designing slim tubes, where the deflection angles—and consequently the coil currents—need to be increased.

Several techniques are used to reduce these errors, such as positioning the coil wires optimally, providing magnets to the deflection core, etc. However, none of these techniques can provide a completely satisfying result, especially for high (>120 degs) deflection angles.

It is an object of the present invention to overcome the above problem, and provide a deflection yoke for a CRT which improves front-of-screen (FOS) performance.

According to the invention, this and other objects are achieved with a yoke ring having an inner and an outer contour, characterized in that said inner contour is periodically deformed in the radial direction, the contour having at least two local minima and maxima.

The invention is based on understanding the behavior of the magnetic field. With a normal deflection yoke, multipoles generated by the coils are reflected in the yoke, which acts like a mirror, amplifying the field. By influencing these multipole reflections, a yoke ring according to the present invention shows improved performance.

In a standard, completely symmetrical and circular yoke ring, each multipole is reflected as the same multipole but with a reduced amplitude. By periodically deforming the inner contour of the yoke ring, e.g. the boundary against which the multipoles are reflected, an n-th order multipole will not only scatter as an n-th order multipole, but several multipoles of higher and lower order will be generated. It is the influence of these additional multipoles that increases the FOS performance.

In first-order perturbation theory, the interaction between the field generated by the coils, represented by a scalar potential $\Phi$, and the perturbation $\epsilon(\theta)$(=deformed radius−undeformed radius at the point with angular position $\theta$) of a circular yoke boundary can be described as follows:

$$\varepsilon(\theta)\frac{\partial\Phi}{\partial n},$$

where n stands for normal. This term describes a first order correction to the boundary potential on the circle. It can be shown that by deforming the radius of a circular yoke with the modulation $\cos(m\theta)$, an n-th order multipole scatters not only as an n-th order multipole, but additionally an n+m-th and an $|n-m|$-th order multipole are generated.

Tests proved that the periodic deformations according to the invention have a positive effect on the FOS performance, reducing astigmatism, coma and raster errors. The astigmatism error refers to the relative position of the blue and red beams with respect to one another. The coma error refers to the difference between the arithmetic average of the blue and red beams and the green beam. These errors are associated with different Fourier components of the magnetic field, where the dipole is associated with the raster error, the quadrupole with the astigmatism error, and the six-pole with the coma error.

The periodic variations in the inner contour are formed around an original diameter, which is a constant in the most common, circular case. However, non-circular yoke rings also exist, in which case the periodic deformations are formed around this non-circular contour. Note that, in this case, the terms local minima and maxima are reserved for the periodic variations. The non-circular basic shape, e.g. an elliptic shape, is thus not considered to have local minima and maxima in the sense of the current invention.

In mathematical terms, the deformations can be regarded as transformations (in polar coordinates) of each point on the yoke boundary:

$$(r, \theta, z)\rightarrow(r+f(\theta), \theta, z),$$

where $f(\theta)$ is a periodic function.

A further advantage of the inventive deformation of the yoke is that it can be used together with all existing techniques for improving FOS performance.

According to a preferred embodiment of the invention, the outer contour is also periodically deformed in a similar way. Although having less impact, these deformations further improve FOS performance. In the latter case, the periodic deformations of the inner and outer contours may be equal, resulting in a constant distance between the boundaries. Tests indicate that this has a positive effect on the improvements of the FOS performance.

The amplitude of the periodic function, i.e. the difference between local minima and maxima may be dependent upon the z value, which is defined as the position along the central axis of the yoke ring. It is also possible to let the amplitude be zero for a substantial part of the yoke axis, resulting in periodic deformations only along a portion of the axial length. A minimum of 10% of the axial length should, however, be deformed in order to achieve the desired effect.

It has been found that correction on the color errors (astigmatism and coma errors) can be obtained mainly by deforming the yoke on the neck side. This is due to the fact that here the coils and the yoke ring lie closer to the electron trajectories and that the influence of the six-pole Fourier component of the field on the coma error is greatest on the neck side. Similarly, raster errors can be corrected mainly by deforming the yoke on the flare (screen) side, where the six-pole component of the field has its greatest influence on the raster error.

The difference between local minima and maxima is preferably at least 0.2 mm. The number of maxima is preferably at least four, which has shown even greaater improvements of performance.

In accordance with a preferred embodiment, the inner and/or outer contour has a radius defined by the function $$r_0+\lambda(a\cos(i\theta)+b\cos(i\theta)),$$

where a, b∈[0,1], i is an integer larger than 1, λ is the amplitude, and $r_0$ is the undeformed base radius. This implies that the deformation is not only periodic, but also harmonic, which has shown to be advantageous.

The inventive yoke ring may be mounted in a conventional deflection unit, which in turn may form part of a CRT.

BRIEF DESCRIPTION OF THE DRAWINGS

These and other aspects of the invention are apparent from the preferred embodiments which will be elucidated with reference to the appended drawings.

DETAILED DESCRIPTION

Figure 1:
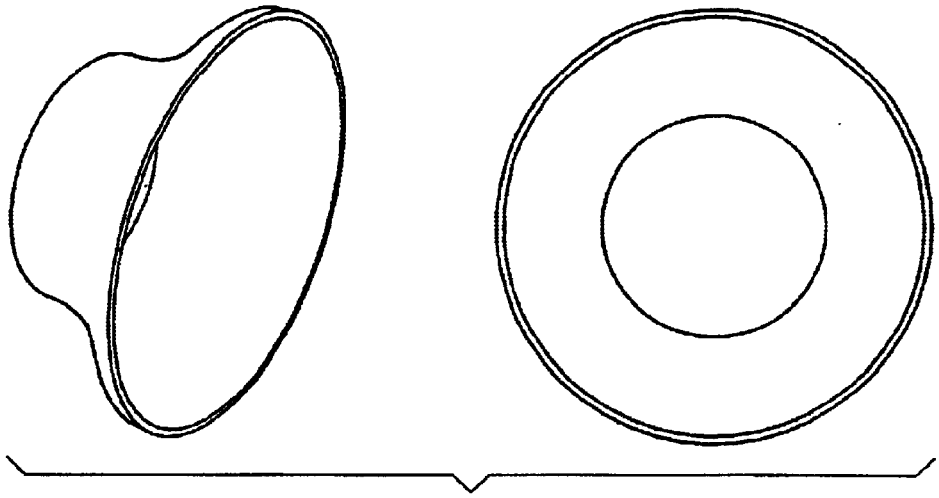
FIG. 1 PRIOR ART
FIG. 1 shows a yoke ring according to the prior art.

FIG. 1 shows a deflection yoke ring with a circular cross-section according to the prior art.

Figure 2:
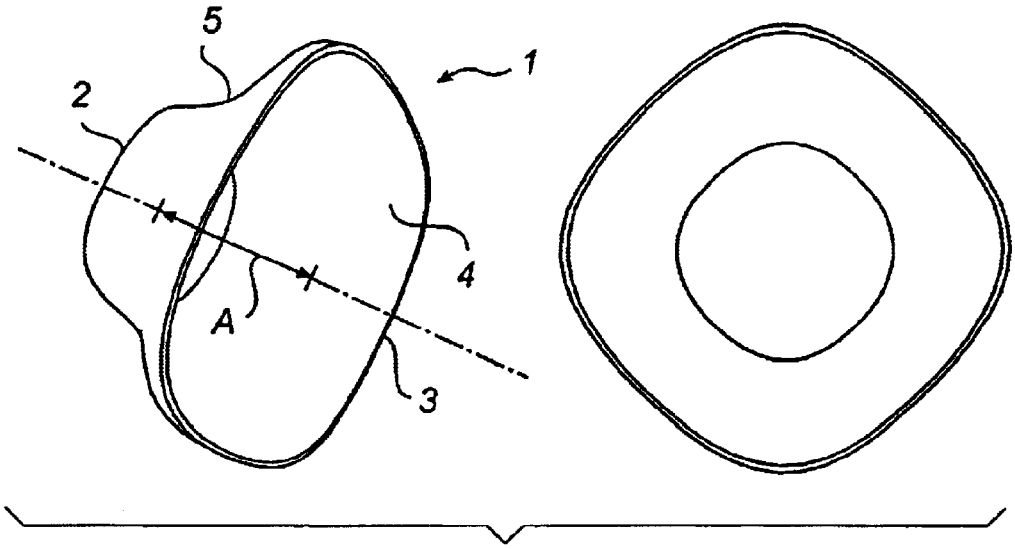
FIG. 2 shows a yoke ring in accordance with an embodiment of the invention.

FIG. 2 shows a yoke ring 1 in accordance with a first embodiment of the invention. The yoke ring has a narrow neck side 2 and a wider flared (screen) side 3, and an inner and an outer contour 4, 5 between the two sides, forming a curved, conical, toroidal shape. The yoke ring 1 is typically made of ferrite.

The preferred deformation is realized by applying a harmonic modulation of the base radius of each contour, $r_0$, in accordance with the formula:

$$r=r_0+\lambda\cos(i\theta),$$

where λ is the amplitude and i is an integer larger than 1. Note that $r_0$ is different for the inner contour and the outer contour.

In FIG. 2, the above formula with i=4 has been used, resulting in 4 maxima 8 and four minima 10 along the inner contour (a more squared shape) Furthermore, the deformation extends along the entire axial length A of the yoke.

It should be emphasized that different values for i, and different axial extensions c an be used, and indeed, a second embodiment is mentioned in the performed tests. It is a matter of testing for the person skilled in the art to determine what parameters are most suitable in each particular case.

In the following, the results of performed tests will be described, with reference to FIGS. 3, 4 and 5. In these tests, different values for λ in the interval 0–1 mm were tried.

The first test was performed on a 32" WS TVT, with deformations along the entire axial length of the yoke. The deformation was in accordance with the above formula, with i=4. The permeability (μ) was assumed to be 500. Color and raster errors were measured and plotted. Note that the tests were performed before optimization of the coils, which is the reason why the errors (with some exceptions) were rather large.

Figure 3A:
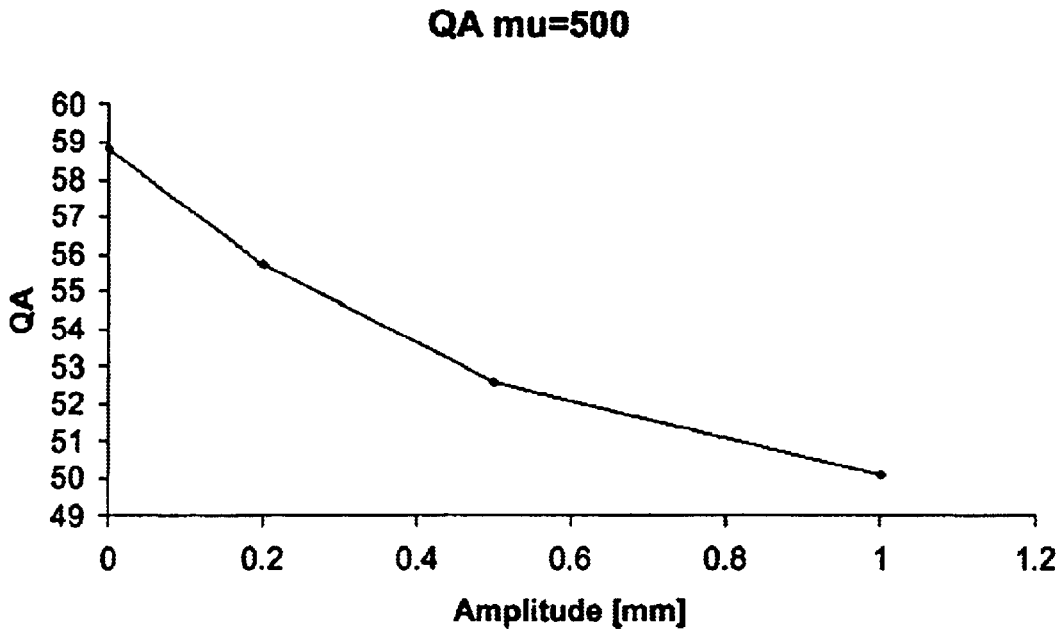
FIGS. 3*a* to *e* show results of tests performed on a 32" WS TVT with a yoke ring in accordance with a first embodiment of the invention.

FIG. 3*a* shows a diagram of the astigmatism error (in mm) as a function of the amplitude λ (in mm). The error was reduced from around 59 mm (λ=0) to around 50 mm (λ=1 mm).

Figure 3B:
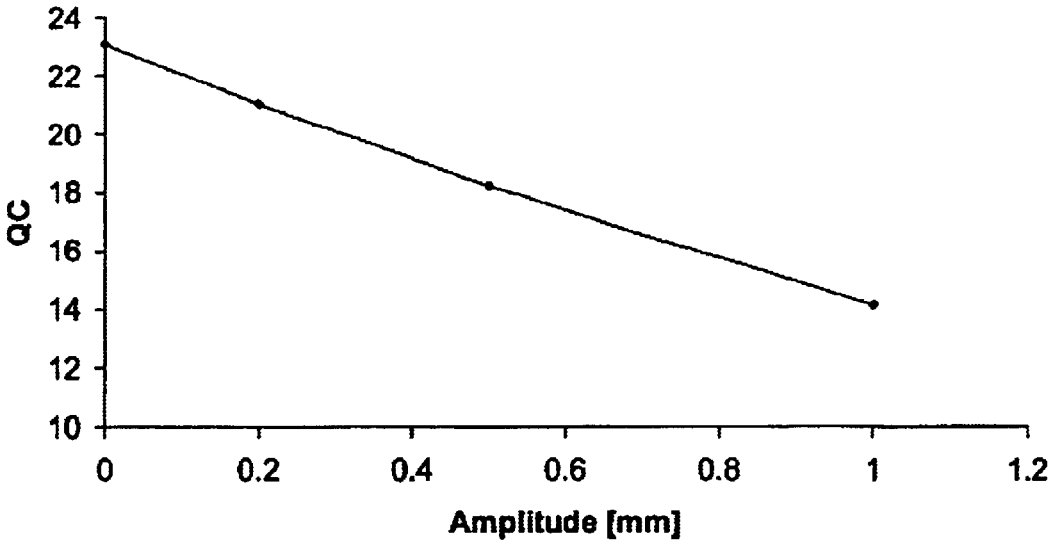

FIG. 3*b* shows a diagram of the coma error (in mm) as a function of the amplitude λ (in mm). The error was reduced from around 23 mm to around 14 mm.

Figure 3C:
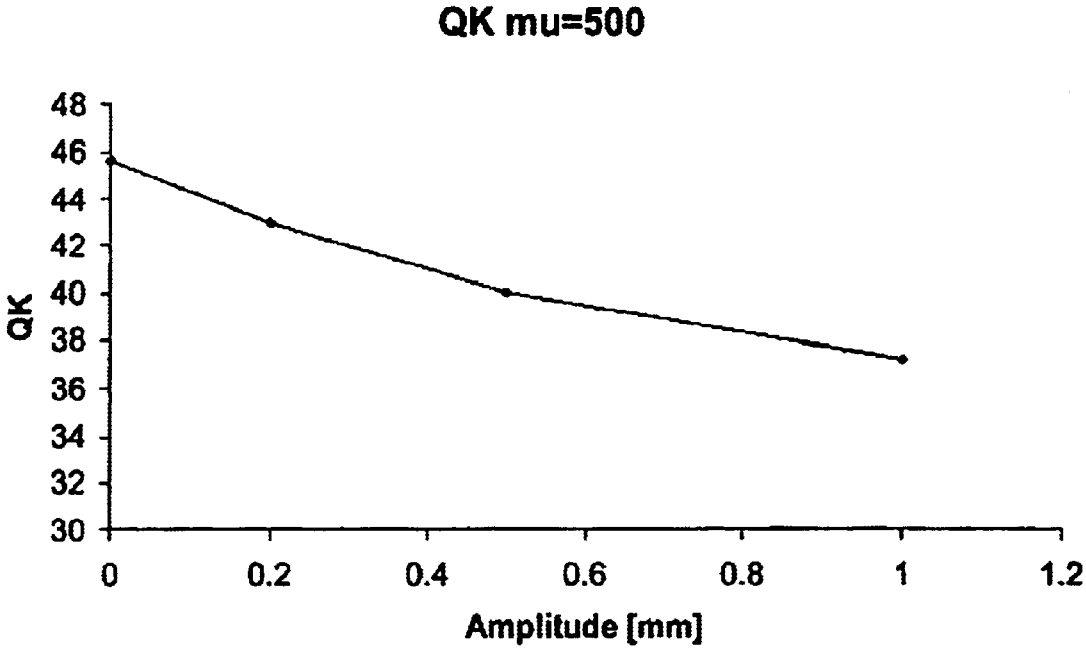

FIG. 3*c* shows a diagram of the average of astigmatism and coma, computed across the screen (in mm) as a function of the amplitude λ (in mm). The average was reduced from about 46 mm to about 37 mm.

Figure 3D:
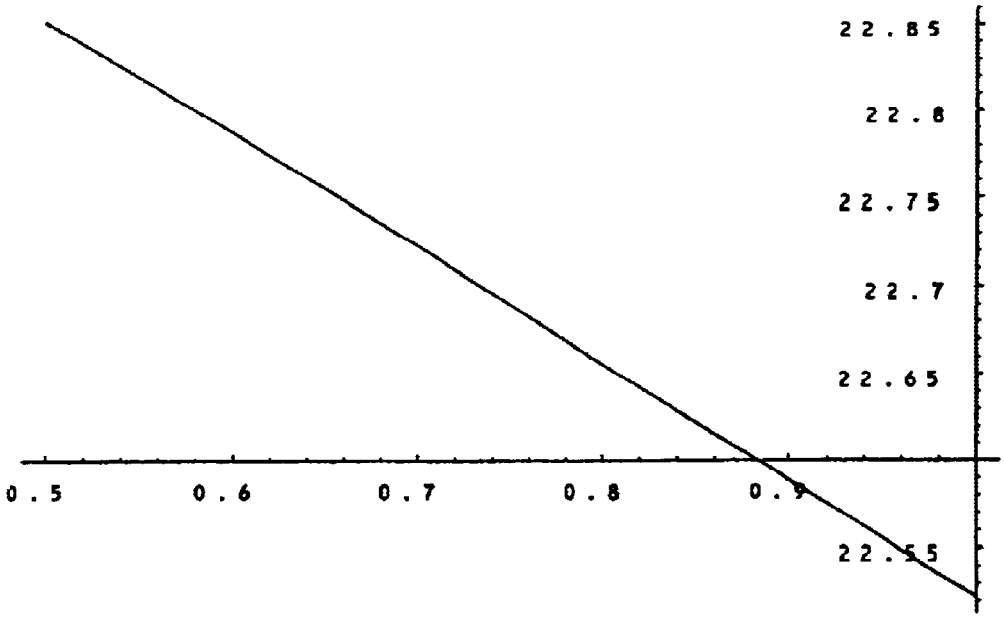

FIG. 3*d* shows a diagram of the raster error (ras-x, in mm) as a function of the amplitude λ (in mm).

Figure 3E:
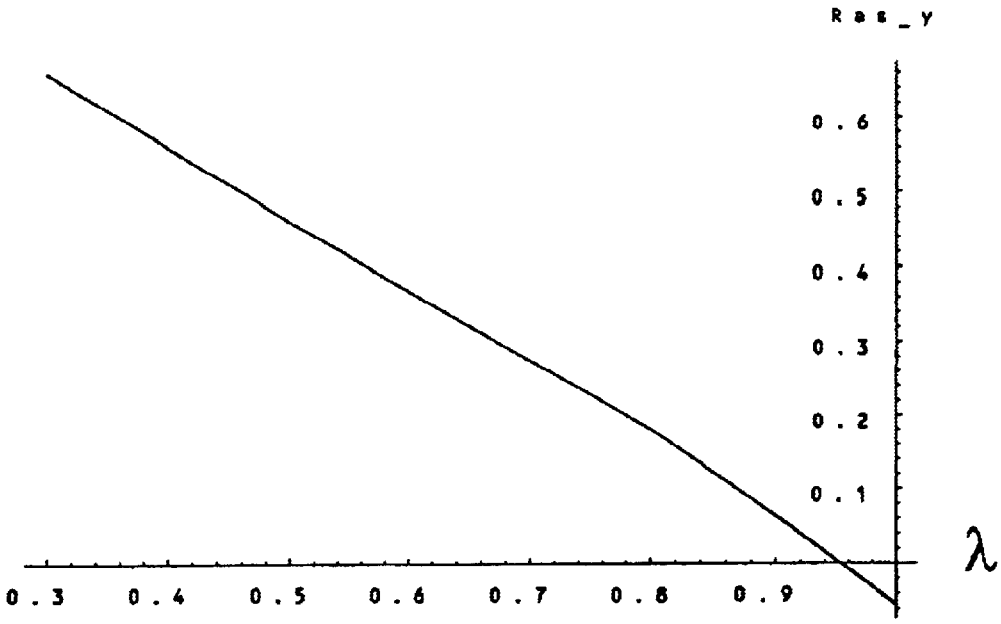

FIG. 3*e* shows a diagram of the raster error (ras-y, in mm) as a function of the amplitude λ (in mm).

The second test was also performed on a 32" WS TVT, but with deformations along only the neck portion of the axial length of the yoke. The deformation was in accordance with the above formula, with i=4. The permeability (μ) was assumed to be 500. Only color errors are shown here, as the screen already has a good raster performance. Again, the tests were performed on an unoptimized screen.

Figure 4A:
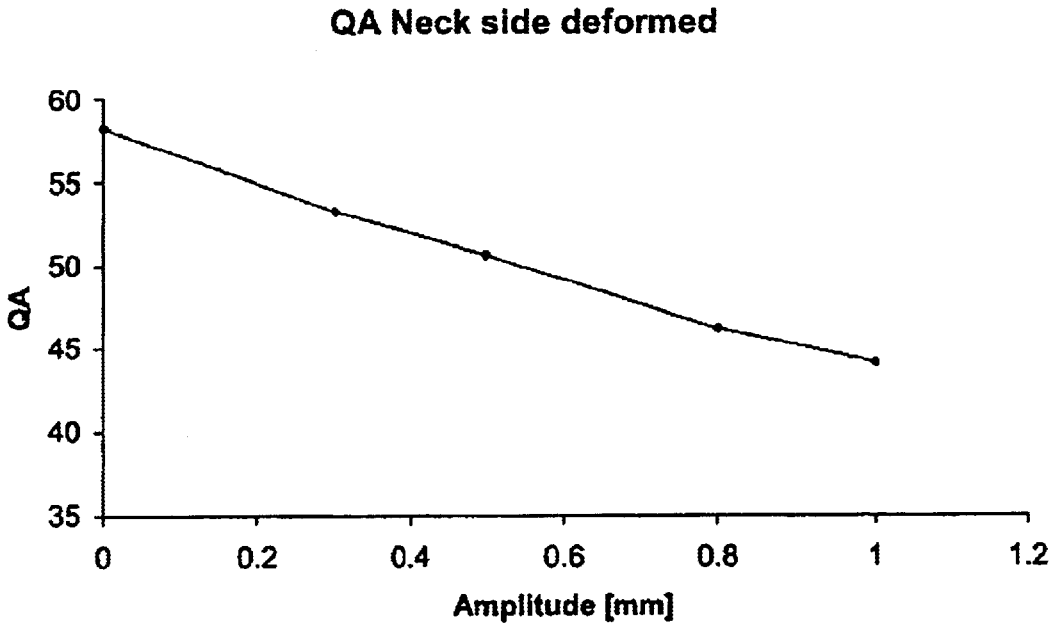
FIGS. 4*a* to *c* show results of tests performed on a 32" WS TVT with a yoke ring in accordance with a second embodiment of the invention.
Figure 5:
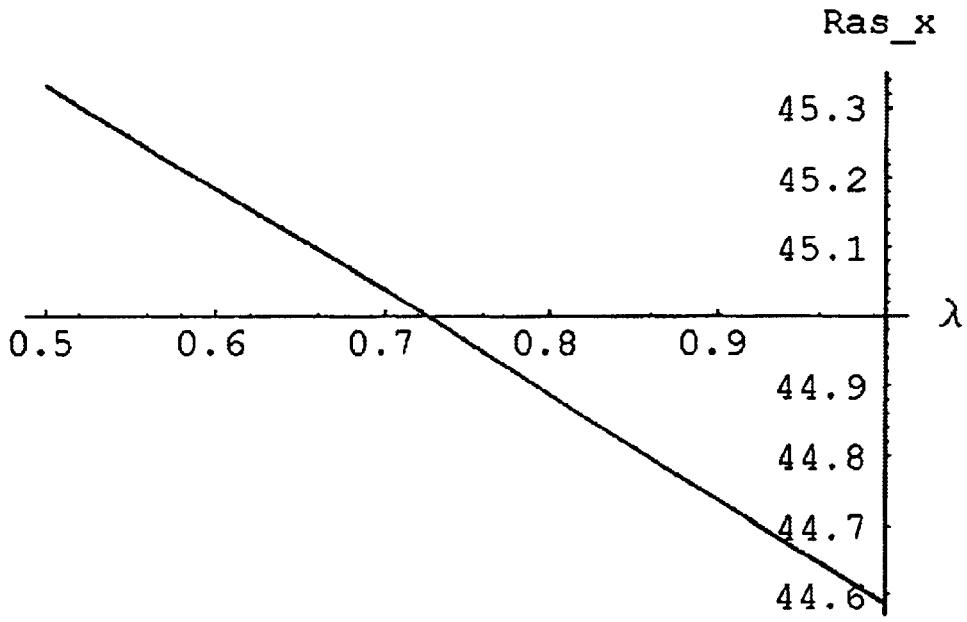
FIG. 5 shows results of a test performed on a 36" TVT with a yoke ring in accordance with the first embodiment.

FIG. 4*a* shows a diagram of the astigmatism error (in mm) as a function of the amplitude λ (in mm). The error was reduced from around 59 mm (λ=0) to around 45 mm (λ=1 mm).

Figure 4B:
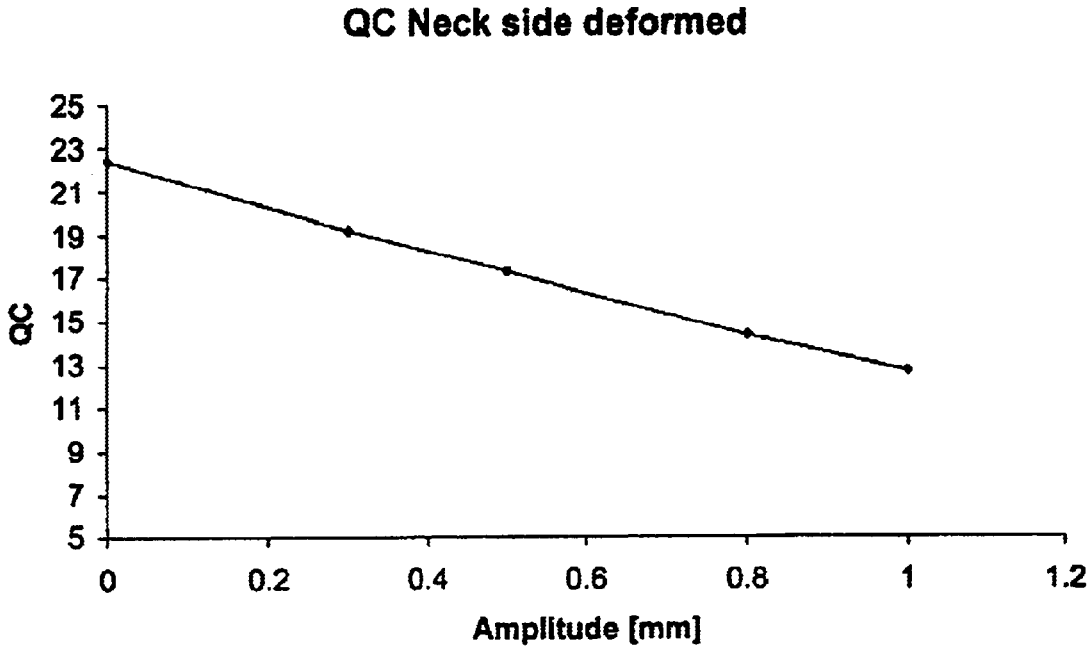

FIG. 4*b* shows a diagram of the coma error (in mm) as a function of the amplitude λ (in mm). The error was reduced from around 23 mm to around 13 mm.

Figure 4C:
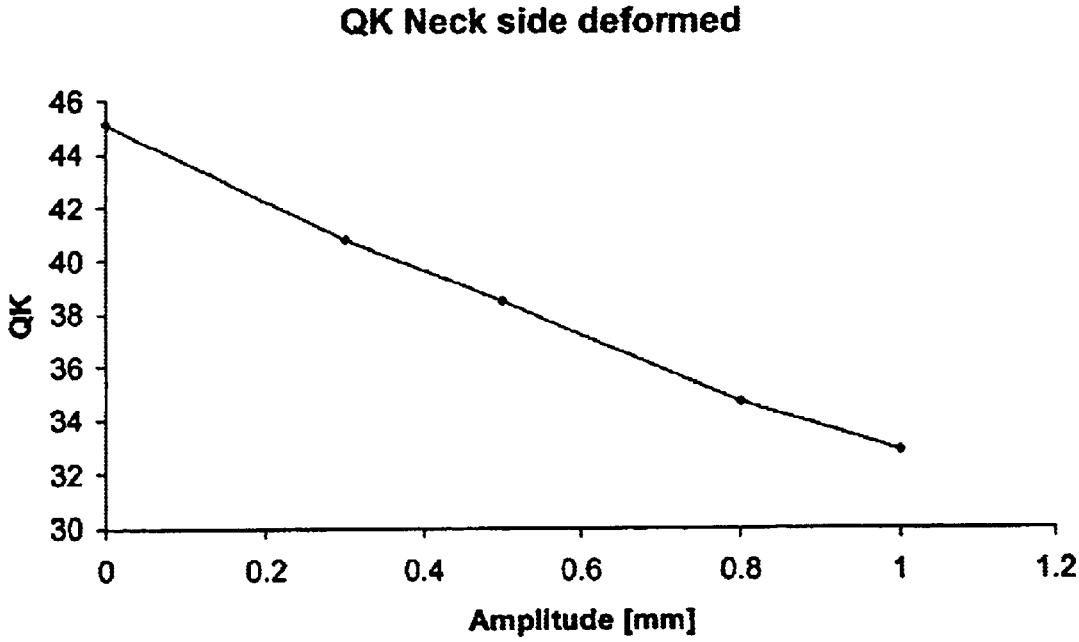

FIG. 4*c* shows a diagram of the average of astigmatism and coma, computed across the screen (in mm) as a function of the amplitude λ (in mm). The average was reduced from about 45 mm to about 33 mm.

It should be noted that the improvements of color errors were essentially equal in tests 1 and 2. The conclusion is that the deformation of the neck side has a major influence on the color errors.

The third test was performed on a 36" TVT, with deformations along the entire axial length of the yoke. The deformation was in accordance with the above formula, with i=4. The permeability (μ) was assumed to be 500. FIG. 5 shows the raster error (ras-x, in mm) as a function of the amplitude λ (in mm).

What is claimed is:

1. A yoke ring for use in a deflection unit in a cathode ray tube (CRT), said yoke ring having a neck and a flared side and defined by an inner and an outer contour, wherein said inner contour is periodically deformed in the radial direction so as to have at least two local minima and maxima, and wherein said inner contour has a radius defined by the function $$r_0+\lambda(a\cos(i\theta)+b\cos(i\theta)),$$

where a, b ∈ [0,1], i is an integer larger than 1, λ is the amplitude, and $r_0$ is an undeformed base radius.

2. A yoke ring as claimed in claim 1, wherein said outer contour is also periodically deformed in the radial direction, also having at least two local minima and maxima.

3. A yoke ring as claimed in claim 2, wherein said inner and outer contours are periodically deformed as to provide a constant distance between said inner and outer contours.

4. A yoke ring as claimed in claim 1, wherein the yoke ring is deformed along at least 10% of its axial length.

5. A yoke ring as claimed in claim 4, wherein the yoke ring is deformed at least on its neck side.

6. A yoke ring as claimed in claim 4, wherein the yoke ring is deformed at least on its flared side.

7. A yoke ring as claimed in claim 1, wherein the local minima and maxima depend upon the position along the central axis of the yoke ring.

8. A yoke ring as claimed in claim 1, wherein the difference between local minima and maxima is in the interval between 0.2 an 1.0 mm.

9. A yoke ring as claimed in claim 1, wherein each contour has at least four local maxima.

10. A yoke ring as claimed in claim 1, wherein said outer contour has a radius defined by the function $$r_0+\lambda(a\cos(i\theta)+b\cos(i\theta)),$$

where a, b $\in$ [0,1] i is an integer larger than 1, $\lambda$ is the amplitude, and $r_0$ is an undeformed base radius.

11. A deflection unit provided with a yoke ring as claimed in claim 1.

12. A CRT provided with a deflection unit as claimed in claim 11.

* * * * *